United States Patent [19]

Corrans

[11] 4,260,477

[45] Apr. 7, 1981

[54] MAGNETIC SEPARATORS

[75] Inventor: Ian J. Corrans, Randburg, South Africa

[73] Assignee: National Institute of Metallurgy, Randburg, South Africa

[21] Appl. No.: 17,283

[22] Filed: Mar. 5, 1979

[30] Foreign Application Priority Data

Mar. 14, 1978 [ZA] South Africa ..... 78/1467

[51] Int. Cl.[3] ..... B03C 1/30

[52] U.S. Cl. ..... 209/38; 209/223 R; 209/232

[58] Field of Search ..... 134/25 R, 68, 104, 134, 134/153, 133; 209/214, 223 R, 222, 221, 232, 225, 38; 210/222, 223

[56] References Cited

U.S. PATENT DOCUMENTS

| | | | |
|---|---|---|---|
| 2,954,122 | 9/1960 | Colburn | 210/222 X |
| 3,375,925 | 4/1968 | Carpenter | 209/214 |
| 3,994,801 | 11/1976 | Colburn | 209/214 |
| 4,066,537 | 1/1978 | Bernfeld | 209/223 R |

FOREIGN PATENT DOCUMENTS

| | | | |
|---|---|---|---|
| 253693 | 1/1970 | U.S.S.R. | 209/38 |

*Primary Examiner*—Ralph J. Hill

*Attorney, Agent, or Firm*—Cushman, Darby & Cushman

[57] ABSTRACT

A magnetic separator comprising an annular housing rotatable about a generally vertical axis and adapted to contain a matrix therein composed of a plurality of separate elements of magnetic material said annular housing being optionally sub-divided into a plurality of partitions around the circumference thereof, outlets for elements constituting the matrix in the lower region of the said partitions, means for releasably opening said outlets at one or more required positions around the circumference of the housing, means for cleaning elements constituting said matrix and which issue from said outlet in use, and further means for returning cleaned elements to the annular housing after cleaning.

13 Claims, 3 Drawing Figures

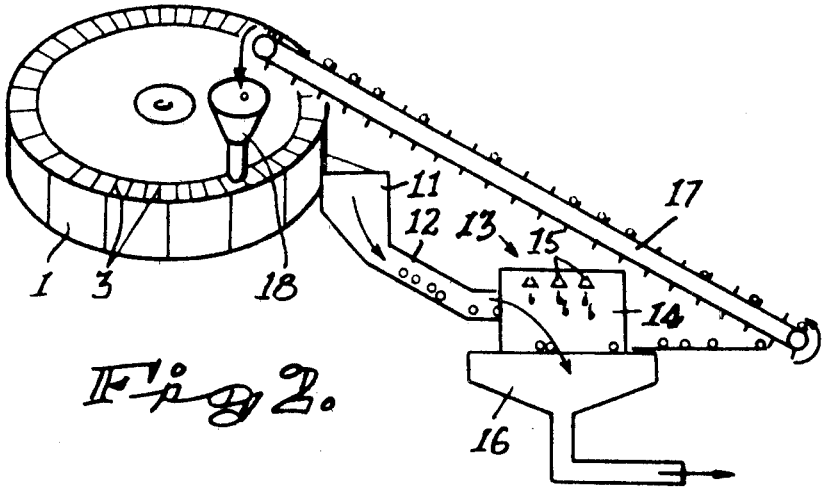
Fig 2.
Fig 3.
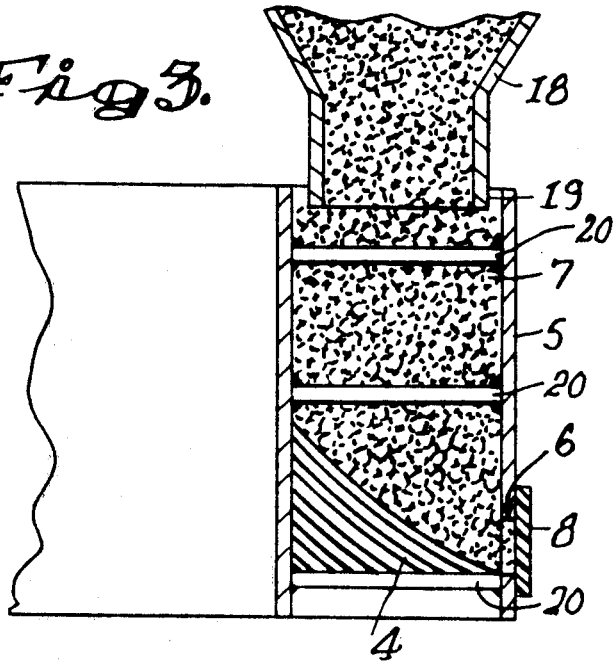

MAGNETIC SEPARATORS

BACKGROUND OF THE INVENTION

This invention relates to magnetic separators used for the separation of certain magnetic materials from relatively less magnetic materials and wherein the separator operates on the principle of passing a confined mass of magnetic bodies together with the material to be separated through a magnetic field and flushing out the relatively non-magnetic material by means of a fluid.

Various magnetic separators of the above general type have been proposed and used but the separators at present available do not operate effectively under certain conditions, such as, where a slurry of material is passed through the mass of magnetic bodies and the slurry contains material which tends to be retained by the mass, with the possibility of an ultimate blockage being formed. This problem arises particularly in the case of wet high intensity magnetic separation.

Wet high intensity magnetic separation (WHIMS) is a method used for separating weak magnetic (paramagnetic) material from non-magnetic material. In order to effect separation, high magnetic field strengths and gradients are necessary. The magnetic field is produced electrically either by windings around an iron yoke or by using the field produced inside a solenoid. Gradients are induced inside the separation volume by placing pieces of magnetically soft iron in the field; these distort the lines of force and hence set up high gradients.

Separation of the magnetic and non-magnetic material takes place within the high intensity high gradient separation zone (or volume). The pieces of magnetically soft iron mentioned above are held within a cannister (for a batch machines) or within a rotating annular housing (carousel) which continually moves through the separation zone. This magnetically soft iron is called the matrix. It serves to produce gradients, as mentioned above, as well as to induce higher magnetic fields. The matrix also serves to slow down the flow of pulp in the separation volume, affording the magnetics more opportunity to be influenced by the magnetic forces and thereby improving the separation. The magnetic material is held by the matrix while the non-magnetic material is flushed through the working volume by the flow of pulp and rinse water or other liquid. The magnetic material is then removed by turning off the field (for a batch machine) or by moving the matrix out of the field (for a continuous machine) and washing with water. Clearly, a continuous machine is desirable for industrial application. Usually such continuous machines utilise a matrix which is carried in an annular cross-sectioned housing rotatable avout a generally vertical axis.

The design of the matrix is quite critical to the efficient separation of any given paramagnetic material from non-magnetic material; e.g for the iron ore haematite, which is a relatively strong paramagnetic material, an open type of matrix has been found to be adequate. By open matrix is meant a matrix with a relatively small resistance to flow. However, for the separation of weak paramagnetic materials, such as the mineral suite containing the Witwatersrand gold and uranium values, a matrix with a higher resistance to flow (i.e a more closed matrix) has been found necessary to give efficient performance of these machines.

One of the most effective materials known at the present time for a closed type of matrix is iron balls (spheres). These may range in diameter from about 2 mm to 15 mm or more depending on the duty. Other materials which have been used are shot, rods, woven wire, wedge wire, nails etc.

The major problem that arises with the closed type of matrix is blockage by ferromagnetics and wood fibre. These latter materials are fairly universal contaminants, especially in ore pulps and accumulate in the the matrix with time. When blockage occurs, it is necessary to stop the machine and clean the matrix. This down-time is a serious drawback to the large scale implementation of WHIMS. The use of complicated feed preparation equipment can alleviate the problem to a degree, by screening out wood fibre and using low or medium intensity magnetic separators for removing ferromagnetics. This has not, however, provided a complete solution.

It must be mentioned that some prior art separators have been made wherein this problem is automatically avoided as a result of the manner in which the magnetic materials are recovered. One such machine is described in U.S. Pat. No. 3,994,801 to Colburn in which a conveyor arrangement is provided and the whole mass of matrix is demagnetised and allowed to tumble freely during washing thereof to recover the magnetic materials. Applicants consider this apparatus to be too complicated or costly, or both, for many applications where a simple annular housing, rotatable about a horizontal axis, is considered desirable.

Another apparatus where the entire matrix is tumbled and washed to recover the magnetic material is described in the Soviet Journal of Non-Ferrous Metals Vo. 10, No. 9, September 1969, at page 35. In this case, an annular framework is rotatable about a horizontal axis and the compartments holding the matrix are all completely emptied to recover the magnetics. A major drawback of removing the entire matrix is the power required to handle the matrix material.

There is thus no simple arrangement known to applicant wherein the magnetic materials can be recovered from the matrix without totally freeing all elements thereof and which yet provides for adequate cleaning of the matrix from contaminants automatically.

DETAILED DESCRIPTION OF THE INVENTION

It is the object of this invention to provide a magnetic separator of the type wherein recovering of magnetic materials from the matrix can be achieved with the matrix in situ in a housing whilst also providing for a continuous feed of the matrix to be cleaned and returned to the separator during operation.

In accordance with this invention there is provided a magnetic separator comprising an annular housing rotatable about a generally vertical axis and adapted to contain a matrix therein composed of a plurality of separate elements of magnetic material, said annular housing being optionally subdivided into a plurality of partitions around the circumference thereof, outlets for elements constituting the matrix in the lower region of the said housing means for releasably opening said outlets at one or more required positions around the circumference of the housing, means for cleaning elements constituting said matrix and which issue from said outlet in use, and further means for returning cleaned elements to the annular housing after cleaning.

Further features of the invention provide for the outlets to be in the form of one or more slots cut in the outer wall of the housing at the bottom of the housing, for the bottom of the housing to be defined by a mesh floor inclined downwardly towards said slots, for the slots to be covered around the major portion of the periphery of the housing by a flexible belt which is guided over rollers to provide an open region of said slots as the housing rotates; for an electromagnet, mechanical scraper or other device to be provided for assisting in drawing matrix elements through the slots at said open region thereof, for a demagnetizer to be provided, if required, for demagnetising said matrix elements prior to washing thereof, and for the matrix elements to be returned to the housing by means of a conveyor or other elevator which may optionally embody said means for cleaning the matrix elements.

It is to be understood that an attractive advantage of a separator according to the present invention is its ability to provide cleaning means for only a small portion of the elements in a locality or partition during each revolution of the housing. This means that the cleaning equipment and conveyor or the like for returning the cleaned elements to the housing can be designed to be as small as possible. This design may be selected so that only the required portion of elements is cleaned per revolution and thus the entire contents of a locality or partition may only be cleaned every 5,10 or more revolutions as may be required to positively prevent any blockages occurring.

The portion of the elements to be cleaned during each revolution of the housing may be removed for cleaning either before or after the magnetic or paramagnetic materials have been washed therefrom at a washing station. However, it is believed that it will be advantageous to wash the matrix to remove the separated magnetics and paramagnetics first simply in order to minimise wear of the matrix.

BRIEF DESCRIPTION OF THE DRAWINGS

The above and other features of the invention will become more apparent from the following description of one embodiment thereof. In this description reference will be made to the accompanying drawings in which:

FIG. 2 is a schematic perspective view illustrating the removal and replacement of matrix elements from the housing; and, FIG. 3 is an enlarged sectional elevation showing the configuration of a compartment in the housing and an alternative construction of the housing.

DETAILED DESCRIPTION OF THE DRAWINGS

Figure 1:
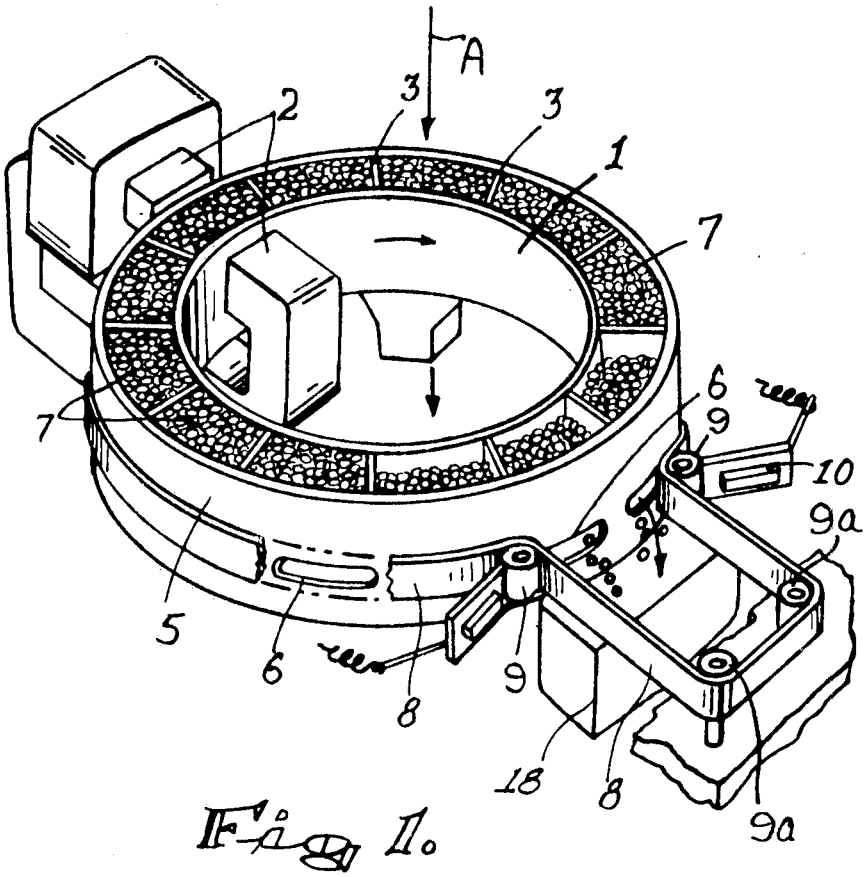
FIG. 1 is an isometric schematic view of a magnetic separator according to this invention with only the relevant parts being shown and with the washing device removed.

In this embodiment of the invention the magnetic separator comprises a substantially conventional annular housing 1 which is rotatable about a vertical axis on a support framework (not shown) therefor. The construction of such a magnetic separator is well known and need not be further described herein. Suffice it to say that a powerful electromagnet 2 is located such that its two poles are located opposite each other on the inside and outside of the annular housing so that a strong magnetic field can be set up therebetween.

The annular space in the housing is, as shown in FIGS. 1 and 2, divided into compartments by means of radially extending walls 3 and the bottom 4 of each compartment is defined by a mesh floor inclined arcuately downwardly towards the outer wall 5 of the housing. Said outer wall 5 of the housing has circumferentially extending slots 6 cut therein whereof the width is sufficient to allow the passage of elements 7 of a matrix therethrough.

Alternatively, the outer wall of the housing would be held in spaced relationship relative to the inner wall by a series of rods or bars 20 as shown in FIG. 3 in which case the partition walls, and thus the partitions, may be obviated.

Conveniently the matrix is composed of ferromagnetic iron balls of a diameter chosen to provide the required flow characteristics through the matrix. It is considered to be desirable to make such balls of a magnetic stainless steel to reduce wear and corrosion.

Around the vast majority of the circumference of the outer walls the slots 6 are covered by means of a flexible belt 8 which is held in tension on the outer surface of the outer walls 5 of the housing. However, a small section of the circumference of the housing has the belt 8 directed away therefrom around rollers 9 so as to provide a region wherein the slots are exposed, and thus open. Two rollers 9 engage the belt to urge it against the housing at the ends of the open region and these rollers are preferably spring loaded towards the housing. Two further rollers **9*a*** hold a region of the belt away from said open region and these rollers are preferably made adjustible in position.

An electromagnet 10 (see FIG. 1) is provided adjacent the slots in the open region thereof so that it can be used to assist the flow of matrix elements out of the slot. In order to achieve this, the electromagnet may be located behind the belt 8 adjacent the region of the mouth of the slot where the belt initially moves away therefrom.

A hopper 11 is located below the open region of the slots so that matrix elements issuing therefrom fall into the hopper and thence down a chute 12 to the washing section indicated generally by numeral 13. The washing section, in this embodiment of the invention, comprises a trommel screen 14 having high pressure water sprays 15 therein. The sprays are located so as to be operative over the major portion of the length of the trommel screen but leaving the outlet region of the screen without sprays to enable effective drainage to take place.

A trough 16 is located below the trommel screen to catch the washings which will generally be added to the separated magnetic or paramagnetic product.

The washing section is designed to ensure that wood fibres and other material is washed off the matrix elements which then proceed to a magnetic conveyor 17 which returns them to the top of the housing and feeds the elements into a hopper 18 whereof the outlet at the lower region thereof is arranged to form a constant upper level to the matrix in the compartments. This is shown in FIG. 3 from which it will be seen that the lower end 19 of the hopper outlet limits the upper level of the matrix elements.

It will be understood that as the housing rotates and the elements are withdrawn from the slots in the open region thereof continuous washing of the matrix is achieved thereby ensuring that no clogging occurs during operation of the separator.

The rate of discharge of balls is dependent on the width of slot and distance between the rollers at the discharge point. A certain percentage of the balls is discharged with each revolution of the rotor, while the turnover time of the entire matrix will be based on the time that blockage takes to occur. If, for example, blockage becomes a problem after eight hours continual operation without washing, the removal and wash system can be designed to turn over and wash the complete matrix once every four hours.

It will be understood that as in use feed material is introduced at a position immediately above the magnetic poles and the feed material is allowed to flow through the matrix and out the bottom between the poles. During this process non-magnetic materials simply flow or are washed through the matrix and para-magnetic or other magnetic materials are retained on the ferro-magnetic matrix. At a position past the poles of the magnet and which is indicated by arrow A the magnetic or para-magnetic materials are washed away from the matrix by a downward flow of fluid.

The position of the open region of the slots is angularly past the wash position indicated by arrow A and, in the case of the embodiment illustrated, the open region of the slots is located directly opposite the electro-magnet. However, as will be understood by those skilled in the art, a plurality of magnetic poles, washing stations and open regions to the slots may be provided around the periphery of a large size magnetic separator. Such an arrangement is known in the art and the present invention simply provides the additional means for continuously cleaning the matrix which is composed of a plurality of separate elements, preferably iron or steel balls.

It will be understood that numerous variations may be made to the above described embodiment of the invention without departing from the scope hereof. In particular, the means for closing the slots may be varied as required and, in fact, the outlet need not assume the shape of a slot. In particular, the outlets may all be defined by a single continuous slot extending around the housing. In such a case the part of the housing defining the lower edge of the slots may be held by brackets or the like secured to the inner wall of the housing and a mechanical scraper can continuously extend into the housing through the slot to urge the matrix elements out at the cleaning region. The partition walls would be shaped in this case to allow the scraper to pass them. The electro-magnet 10 may then be rendered obsolete. Also, the elements may simply fall out of the slots depending on the design considerations of the separator. Whilst demagnetisation of the matrix elements has been found to be unnecessary thus far, a demagnetising arrangement for the matrix elements being washed could be employed. Finally, the belt could be replaced by individual closure plates, for example, rotatable in a plane which is tangential to the water cylindrical surface of the housing. A further alternative is to provide each compartment with a hinged grid or mesh bottom which can be opened to allow a desired proportion of the matrix elements to fall out of the compartments for washing purposes.

What I claim as new and desire to secure by Letters Patent is:

1. A magnetic separator comprising an annular housing rotatable about a generally vertical axis and adapted to contain a matrix therein composed of a plurality of separate elements of magnetic material, outlets for elements constituting the matrix in the lower region of the said annular housing, means for releasably opening said outlets at one or more required positions around the circumference of the housing, means for cleaning elements constituting said matrix and which issue from said outlet wherein only a portion of the matrix elements in a locality is cleaned during one revolution of the housing in use, and further means for returning cleaned elements to the annular housing after cleaning.

2. A magnetic separator as claimed in claim 1 in which the outlets are in the form of slots provided in the lower region of the outer wall of the housing.

3. A magnetic separator as claimed in claim 2 in which the slots are covered around the major portion of the periphery of the housing by a flexible belt guided over rollers to provide an open region of said slots as the housing rotates in use.

4. A magnetic separator as claimed in claim 1 in which the bottom of the housing is defined by a mesh or grid floor inclined downwardly towards the outlet from the housing.

5. A magnetic separator as claimed in claim 1 in which an electro-magnet is provided adjacent to outlets in the region where they are open for urging matrix elements out of said outlets.

6. A magnetic separator as claimed in claim 1 in which the means for cleaning matrix elements is a trommel screen and spray arrangement adapted to spray high pressure cleaning water onto matrix elements passing through the trommel screen.

7. A magnetic separator as claimed in claim 1 in which a conveyor is provided for returning cleaned matrix elements to the housing.

8. A magnetic separator as claimed in claim 1 in which the cleaned matrix elements are returned to the housing via a hopper, the outlet from which is adapted to define a constant level of elements in the housing.

9. A magnetic separator as claimed in claim 1 wherein the matrix elements in a locality are cleaned of their entire contents about every 5 to 10 revolutions of the housing in use.

10. A magnetic separator as claimed in claim 1 in which the outer and inner walls of the annular housing are secured relative to each other by members welded, or otherwise secured, to said walls, the members being partition walls to define compartments.

11. A magnetic separator as claimed in claim 1 wherein said annular housing is sub-divided into a plurality of compartments around the circumference thereof.

12. A magnetic separator as claimed in claim 11 in which the outer and inner walls of the annular housing are secured relative to each other by welded partition walls to define partitions around the circumference of the housing.

13. A magnetic separator as claimed in claim 1 in which the outer or inner walls of the annular housing are secured relative to each other by rods or bars welded or secured to said walls.

* * * * *